United States Patent [19]

Leino

[11] Patent Number: 4,970,846

[45] Date of Patent: Nov. 20, 1990

[54] PRODUCT SUPPORT TABLE HAVING MULTIPLE PRODUCT TRANSPORT BELTS

[75] Inventor: Lawrence L. Leino, Green Bay, Wis.

[73] Assignee: FMC Corporation, Chicago, Ill.

[21] Appl. No.: 446,035

[22] Filed: Dec. 5, 1989

[51] Int. Cl.[5] ..... B65B 9/06; B65B 51/26; B65B 53/02

[52] U.S. Cl. ..... 53/550; 53/372; 53/373; 53/557; 156/466; 493/369; 493/477

[58] Field of Search ..... 53/209, 372, 373, 545, 53/547, 548, 549, 550, 557; 156/203, 466; 198/817; 493/125, 179, 182, 369, 477

[56] References Cited

U.S. PATENT DOCUMENTS

| | | | |
|---|---|---|---|
| Re. 30,791 | 11/1981 | Kupcikevicius | 198/817 X |
| 3,553,933 | 1/1971 | Seko | 53/550 |
| 4,216,638 | 8/1980 | Yoshida | 156/466 |
| 4,288,968 | 9/1981 | Seko et al. | 53/550 |
| 4,587,794 | 5/1986 | Kopp | 53/550 |
| 4,696,147 | 9/1987 | Noh | 53/550 |
| 4,715,166 | 12/1987 | Kameda | 53/550 |
| 4,761,937 | 8/1988 | Francioni | 53/550 |
| 4,870,802 | 10/1989 | Cerf | 53/373 X |

FOREIGN PATENT DOCUMENTS

| | | | |
|---|---|---|---|
| 1011428 | 12/1965 | United Kingdom | 53/550 |

*Primary Examiner*—Robert L. Spruill
*Assistant Examiner*—Linda B. Johnson
*Attorney, Agent, or Firm*—Douglas W. Rudy; Richard B. Megley

[57] ABSTRACT

A product support table, having an elongated longitudinal opening is positioned over a pair of fin seal wheels which provide a seal between two edges of a sheet of film that has been wrapped around an article. The product support table supports a pair of product transport belts that are located between the product being wrapped and the product support table. The belts run the length of the product support table generally in contact with the top side of the table and then, on the return run, are directed upwardly to the bottom of the product support table for most of its travel back to a drive roll and a belt take-up roll.

7 Claims, 3 Drawing Sheets

PRODUCT SUPPORT TABLE HAVING MULTIPLE PRODUCT TRANSPORT BELTS

BACKGROUND OF THE INVENTION

This invention has to do with the wrapping of articles at high speed on equipment that fully incapsulates the product being wrapped in a plastic film wrap that is formed from a flat sheet unwound from a roll of plastic film.

It is well known in the article wrapping industry to provide equipment that will enclose an article in a flat sheet of wrapper film and then join the outboard edges of the film together using a "fin seal" style seal to form a tube of material. The tube of material, now surrounding the product to be wrapped is then end sealed or crimped. Fin seal style seals generally fuse the two edges of the film together using a mechanical or glued connection to provide the connection.

The specific improvement to fin seal wrappers provided in this application are directed to apparatus that is designed for uses in a food handling environment where accessibility to components is critical to ensure that proper cleaning of the apparatus can be carried out on a frequent basis. The invention provided here is a product support table covering a pair of fin seal wheels and other apparatus and having a plurality of belts adjacent the top and bottom sides of the product support table.

SUMMARY OF THE INVENTION

A product support table, having an elongated longitudinal opening is positioned over a pair of fin seal wheels which are used to providing a seal and connection between two edges of a sheet of film that has been wrapped around an article being wrapped. The product support table supports a pair of product transport belts that will be intersticiated between the product being wrapped and the product support table. The belts will run the length of the product support table generally in contact with the top side of the table and then, on the return run, will be directed upwardly to the bottom of the product support table for most of its travel back to a drive roll and a belt take-up roll.

BRIEF DESCRIPTION OF THE DRAWING FIGURES

The invention presented herein will be understood by a reading of this specification in conjunction with a review of the drawing figures wherein.

DETAILED DESCRIPTION OF THE INVENTION

Figure 1:
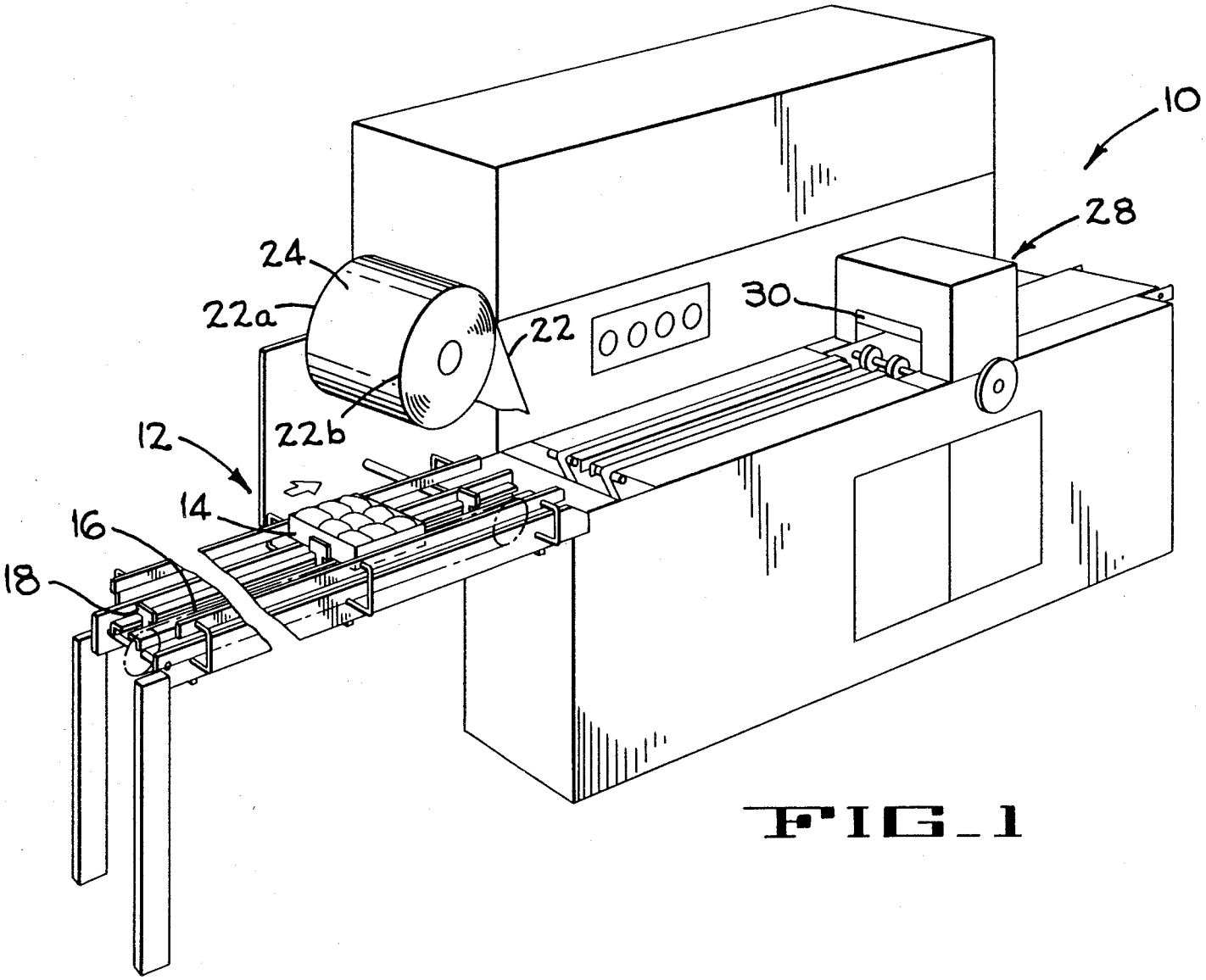
FIG. 1 is a pictorial representation of a wrapper showing the environment of the invention.

The orthographic protection view of FIG. 1 is provided to show the general environment of the invention. The wrapper, generally 10 includes an infeed section generally 12 where product to be wrapped, in the case shown, chicken parts in trays 14, is supported on and moved along a conveyor system 16 through the use of pusher paddles 18.

The products, 14, are fed into a tube forming section, (not shown) wherein flat sheet film 22 is fed from a film roll 24 through a forming guide. The forming guide will direct the edges **22*a* and 22*b* of the film 22 toward each other and around the product 14 passing into the tube forming section generally 20. In a preferred embodiment, the film will cover the top of the product, wrap around the longitudinal edges of the product and meet somewhat in the center of the bottom of the product. The edges, 22*a* and 22*b* of the flat sheet film will be caught between a pair of friction draw rolls such that the film edges will be held perpendicularly relative to the bottom of the product. A pair of heated fin seal rolls will seal the film edges together and allow severing of the selvage edge. The selvage edge being that excess film that is not needed after the film edges have been spliced together to form a tube. The product, now in a tube, of film will pass into an end sealing section. Generally 28 where a sealing bar 30 will seal the tube at each end of the product 14. The sealing bar 30** will also allow severing of the film tube between products so that each product is now individually wrapped in its own film container.

After each product is wrapped it may pass into a shrink wrap heating chamber where the film could be, and in the preferred embodiment, would be, shrunk around the product. Wrapped product will exit the wrapper by conventional means such as a conveyor and proceed to the next packing or processing step.

Figure 2:
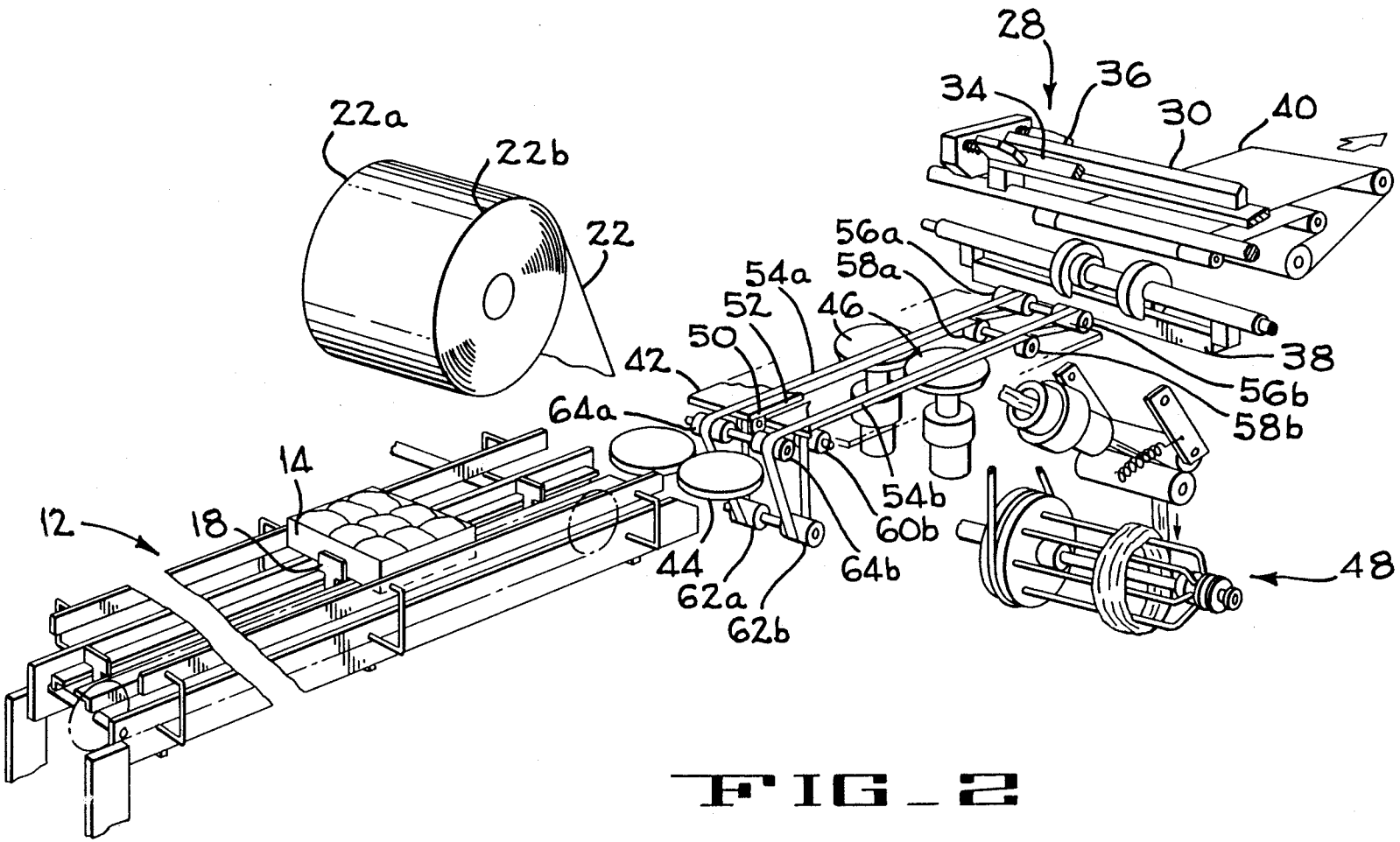
FIG. 2 is representation of the invention with numerous parts broken away and removed to show the invention in relationship to other elements of the wrapper generally shown in FIG. 1.

A less pictorial and more detailed drawing figure, FIG. 2 more clearly shows the invention. In this figure the infeed section, generally 12 supports a product 14, which is pushed along the infeed section by pusher paddle 18. Film 22 would be fed into the film forming guide. The guide has been left out of this drawing figure for clarity but is conventional and well known in the art.

The end sealing section, generally 28, includes the sealing bar 30, a leading film hold down bar 34, a trailing film hold down bar 36, and a sealing bar platen 38. Conveyor 40 is also shown in this figure.

Between the product infeed section, generally 12, and the end sealing section, generally 28, is a product support table. The product support table or top plate 42, shown in a phantom line in FIG. 2 and also shown in FIGS. 3 and 4 covers a pair of friction draw rolls 44 and a pair of fin seal rolls 46 which will seal the edges of the film 22 together (leaving some selvage) in a known manner. The selvage may be removed through the use of a selvage salvage system generally 48.

The product support table 42 is a generally elongated rectangular plate having a gradual film intake throat 50 leading into a longitudinal elongated slot 52 which may terminate past the fin seal wheels prior to the end of the product support table 42. The edges **22*a* and 22*b* of the film 22 are gripped by the draw rolls 44 as the edges enter the film intake throat 50. The edges then proceed to the fin seal wheels 46 where the two edges 22*a* and 22*b* are fused together by the heated and pressurized fin seal rolls. The selvage 22*a* and 22*b* is then directed into the selvage salvage system generally 48 before the selvage or trimmed off edges reaches the end of the elongated slot 52**.

Figure 4:
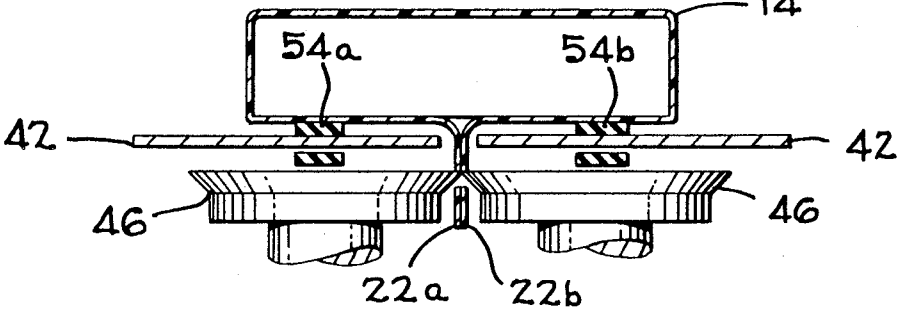
FIG. 4 is a section view through 4—4 of FIG. 3.

Belts **54*a* and 54*b* will assist in propelling the products 14, which are now in an at least partially formed tube of film, along the surface of the product support table 42. These belts are continuous belts driven by drive sheaves 56***a* and 56*b*. From these drive sheaves the belts will proceed in a clockwise direction to an idler roll 58 (a and b) to a location just under the product support table 42. From this idler roll the belts pass between the bottom surface of the product support table 42 and the top of the fin seal wheels such as 46 as shown in FIGS. 2 and 4. The belts will then pass to a second set of idler rolls 60*a* and *b* which will keep the belts close to the bottom of the product support table 42 and above the tops of the fin seal wheels. After passing this idler 60*b* the belts can be directed around a pair of belt tensioning rolls 62*a* and *b* before being entrained around a third set of idler rolls 64*a* and *b* which will direct the belts above the product support table once again.

The product 14 rides on these belts along the product support table 42 until the product is delivered to the end sealing section 28 of the wrapper.

The belts are held in a position, on the return run. close to the bottom of the product support table 42. This leaves the area of the fin seal rolls accessible for adjustments and cleaning. In prior art devices a typical belt path would direct the belt in an 'open rectangle' form that would block or at least impair unlimited access to the fin seal roll area. In the wrapper contemplated as incorporating this invention it is expected that access to the fin seal area for the purpose of cleaning would be necessary, thus access to the fin seal roll areas is desirable. This area could be pressure washed or steam cleaned more easily if the belts were out of the way as shown in the drawing figures.

Figure 3:
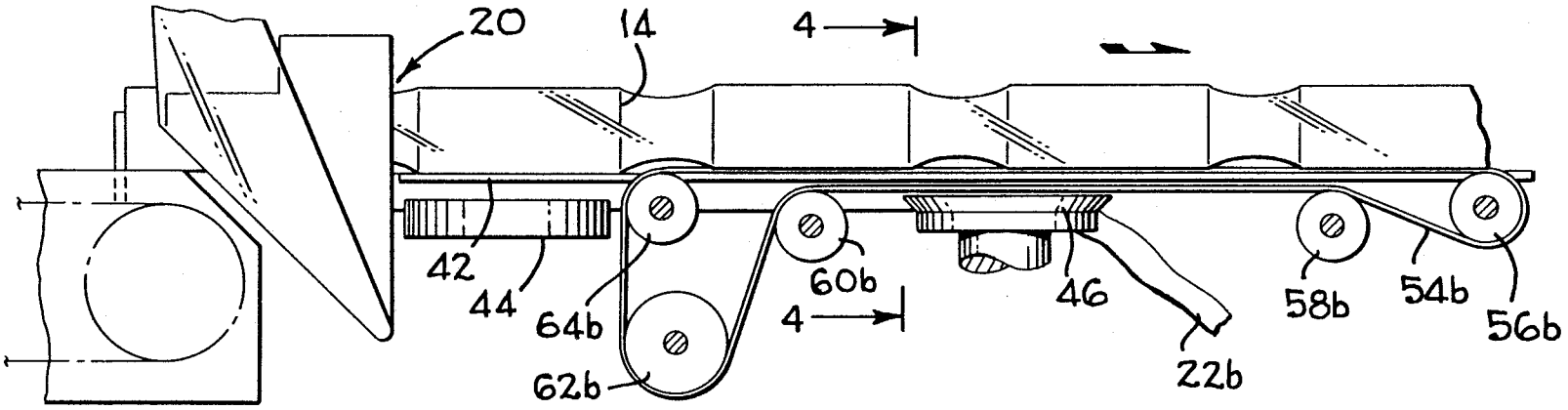
FIG. 3 is a side elevation view of the invention showing product on top of the product support table and the path of the product transport belt.

FIGS. 3 and 4, particularly FIG. 4, shows the section view 4—4 of FIG. 3 in a spaced apart presentation to clearly show that the belts 54*a* and *b* pass between the underside of the product support table 42 and the tops of the fin seal rolls 46. In the actual embodiment the fin seal wheels will be positioned closer to the underside of the table.

What should be evident from the above is that a wrapper is provided that wraps articles in a tube made from a sheet of film in a conventional manner. The invention presented herein however improves conventional wrapping by routing the product transport belts between the tops of the fin seal wheels and the bottom surface of the product support table.

Thus it can be seen that an improved wrapper is provided having a product delivery belt system that directs the belts between the fin rolls and the bottom of the product support table in order to provide access to the fin seal roll area without the impediment of interference from the product delivery belts. The following claims have been drafted to claim the essence of this invention and nuances of ordinary skill and equivalent constructions are contemplated as being within the scope of the appended claims.

What is claimed is:

1. In a wrapper for wrapping articles initially in a tube of film, said wrapper having a pair of fin seal wheels wherein said fin seal wheels are used to create a tube of film out of a flat sheet of film, the improvement comprising:

a product support table positioned over said fin seal wheels, said product support table having an elongated slot formed longitudinally therein extending from a first end through to a point inboard of a second end of said product support table;

at least a single belt entrained longitudinally around said product support table outboard of said longitudinal elongated slot;

means supporting said pair of fin seal wheels under said product support table;

means supporting said belt so that said belt passes between said fin seal wheel and the bottom of said product support table.

2. The invention in accordance with claim 1 wherein a pair of belts are entrained longitudinally around said product support table.

3. The invention in accordance with claim 2 wherein both belts pass between said fin seal wheels and the bottom of said product support table.

4. The invention in accordance with claim 3 wherein said belts are driven by drive sheaves located outboard of the second end of said product support table.

5. The invention in accordance with claim 4 wherein said belts are directed to a position closely adjacent the bottom surface of said product support platform by an idler roll downstream of said fin seal wheels.

6. The invention in accordance with claim 5 wherein said belts are entrained around an idler roll located outboard of the first end of said product support table.

7. The invention in accordance with claim 6 wherein a second idler roll retains said belts closely adjacent the bottom surface of said product support platform upstream of said fin seal wheels.

* * * * *